US010160593B2

(12) United States Patent
Sytsma

(10) Patent No.: US 10,160,593 B2
(45) Date of Patent: Dec. 25, 2018

(54) CONTAINER FOR REDUCING DETERIORATION OF HORTICULTURAL PRODUCE

(71) Applicant: Visy R & D Pty Ltd, Southbank (AU)

(72) Inventor: Russell Allan Sytsma, Brisbane (AU)

(73) Assignee: Visy R & D Pty Ltd, Victoria (AU)

( * ) Notice: Subject to any disclaimer, the term of this patent is extended or adjusted under 35 U.S.C. 154(b) by 362 days.

(21) Appl. No.: 14/902,821

(22) PCT Filed: Jul. 2, 2014

(86) PCT No.: PCT/AU2014/050105

§ 371 (c)(1),
(2) Date: Jan. 4, 2016

(87) PCT Pub. No.: WO2015/000030

PCT Pub. Date: Jan. 8, 2015

(65) Prior Publication Data

US 2016/0176621 A1 Jun. 23, 2016

(30) Foreign Application Priority Data

Jul. 5, 2013 (AU) ..... 2013902487

(51) Int. Cl.
*B65D 73/00* (2006.01)
*B65D 85/50* (2006.01)
(Continued)

(52) U.S. Cl.
CPC ..... *B65D 85/50* (2013.01); *B65D 5/244* (2013.01); *B65D 5/3642* (2013.01); *B65D 65/40* (2013.01)

(58) Field of Classification Search
CPC ..... B65D 85/50; B65D 5/244; B65D 5/3642; B65D 65/40; B65D 5/563
(Continued)

(56) References Cited

U.S. PATENT DOCUMENTS 2,630,263 A 3/1953 Ringler
3,386,644 A * 6/1968 Zackheim ..... A61B 10/0045 229/117.03

(Continued)

FOREIGN PATENT DOCUMENTS

AU 2008/249440 6/2010

OTHER PUBLICATIONS

International Search Report from PCT/AU2014/050105 dated Aug. 19, 2014.

*Primary Examiner* — Luan K Bui
(74) *Attorney, Agent, or Firm* — Swanson & Bratschun, L.L.C.

(57) ABSTRACT

A container for reducing deterioration of horticultural produce, including a parallelogram base member; first and second parallelogram side members, each extending substantially normally from respective opposed sides of the base member; first and second parallelogram end members, each extending substantially normally from respective opposed ends of the base member; and four webbings coupled between neighboring end sections of side members and end members, wherein each webbing of said webbings includes inner and outer triangular sections having a common apex at the base member and wherein the inner triangular section of each webbing is foldable to overlie an external side of a respective one of said end members.

15 Claims, 6 Drawing Sheets

(51) Int. Cl.
*B65D 65/40* (2006.01)
*B65D 5/24* (2006.01)
*B65D 5/36* (2006.01)

(58) Field of Classification Search
USPC ..... 206/423; 229/125.35, 186; 428/34.2
See application file for complete search history.

(56) References Cited

U.S. PATENT DOCUMENTS

| | | | | | |
|---|---|---|---|---|---|
| 3,812,641 | A | | 5/1974 | Bemiss | |
| 3,913,823 | A | * | 10/1975 | Lin | B65D 5/248 229/126 |
| 3,927,505 | A | * | 12/1975 | Bemiss | B65B 7/2807 229/125.33 |
| 4,019,675 | A | * | 4/1977 | Andersson | B65D 5/2047 229/125.17 |
| 4,260,098 | A | * | 4/1981 | Manizza | B65D 5/2047 229/114 |
| 4,930,639 | A | * | 6/1990 | Rigby | B65D 5/5455 229/120 |
| 4,949,900 | A | * | 8/1990 | Ballu | B30B 9/3032 100/229 A |
| 2003/0197053 | A1 | * | 10/2003 | Haraldsson | B65D 5/246 229/186 |
| 2006/0151584 | A1 | | 7/2006 | Wonnacott | |
| 2014/0217161 | A1 | * | 8/2014 | Chalifoux | B65D 5/665 229/186 |

* cited by examiner

CONTAINER FOR REDUCING DETERIORATION OF HORTICULTURAL PRODUCE

RELATED APPLICATIONS

This application is a 35 U.S.C. § 371 national phase application of PCT/AU2014/050105 (WO 2015/000030), filed on Jul. 2, 2014, entitled "Container for Reducing Deterioration of Horticultural Produce", which application claims the benefit of Australian Application No. 2013902487, filed Jul. 5, 2013, which is incorporated herein by reference in its entirety.

TECHNICAL FIELD OF THE INVENTION

The present invention relates to a container for reducing deterioration of horticultural produce.

BACKGROUND OF THE INVENTION

It is generally desirable to maintain the quality, for as long as possible, of freshly packed horticultural produce, such as fruit and vegetables, to ensure consumer acceptability. Quality deterioration of horticultural produce comes about through water loss for the tissue. Methods of inhibiting the deteriorative enzyme reactions, and the growth of yeasts, moulds and bacteria involve the reduction of the produce temperature to between 1° to 12° C., and the creation of low $O_2$ or high $CO_2$ modified atmospheres around the produce. Water in fruits and vegetables can be lost readily under low relative humidity conditions with the consequence of skin wrinkling, wilting and reduction in crispness. The rate of water loss from produce can be restricted by storing the produce in closed package systems consisting of walls with low moisture permeability.

A previous solution to the problem of inhibiting deterioration of produce involved packing the produce in polystyrene creates with ice. Polystyrene has good insulative properties and the container made therefrom do not require erection for use. However, the containers are rigid formed products which require considerable room for transportation and storage prior to use. Further, polystyrene is not deemed environmentally friendly and the end user may be forced to pay disposal costs. Finally, the polystyrene product structure can be compromised by impact during use which may reduce its ability to inhibit spoilage of the produce stored therein.

U.S. Pat. No. 5,609,293 provides an alternative solution to this problem. U.S. Pat. No. 5,609,293 provides of a polymer film as a liner on the inner surface of a corrugated board box. Specifically, U.S. Pat. No. 5,609,293 provides:

> construction and use of lined or coated corrugated paperboard package systems (e.g. boxes, cartons) for prolonging tale storage life of fresh fruits and vegetables under modified atmospheres (MA) in the headspaces of the closed package systems. In particular, the invention is concerned with the placement of various types of gas-permeable linings or coatings on the inside surface of corrugated paperboard, and with the design of die-cut patterns of the lined or coated corrugated paper boards to render the folded, sealed MA packages airtight (no air holes) and stackable. (Column 2, Lines 18 to 28)

U.S. Pat. No. 5,609,293 may go some way to providing an improved container for reducing deterioration of horticultural produce. However, container needs to be constructed from the blank by the farmer on site which includes the step of sealing the columns (35) with a glue (28). The farmer needs to have specialised glue and associated equipment to perform this task. In short, construction of the container from the blank by the farmer may be time consuming, labour intensive and expensive. Further, the glued columns (35) and associated vents (38) shown in FIG. 6, for example, may fail and leak fluid, such as ice water, from the container during use. It is generally desirable to inhibit leakage of fluids from the container during use.

As an alternative to using ice to reduce spoilage. Breatheway™ introduced a bagged product that reduced the respiration rate of produce contained therein. The Breatheway™ bagged product may have an advantage in that ice is not needed to inhibit spoilage between field and market. However, there is an additional cost involved in using the bags and additional labor involved in packing individual bags with produce.

It is generally desirable to overcome or ameliorate one or more of the above mentioned difficulties or at least provide a useful alternative.

SUMMARY OF THE INVENTION

In accordance with one aspect of the invention, there is provided a container for reducing deterioration of horticultural produce, including:

(a) a parallelogram base member;
(b) first and second parallelogram side members, each extending substantially normally from respective opposed sides of the base member;
(c) first and second parallelogram end members, each extending substantially normally from respective opposed ends of the base member; and
(d) four webbings coupled between neighbouring end sections of side members and end members, wherein each webbing of said webbings includes inner and outer triangular sections having, a common apex at the base member and wherein the inner triangular section of each webbing is foldable to overlie an external side of a respective one of said end members.

Preferably, each inner triangular section extends between the base member and an upper section of a respective one of said end members.

Preferably, the inner triangular section of each webbing overlies and is coupled to an external side of a respective one of said end members.

Preferably, each inner triangular end section is coupled to a respective one of said end members by a fastener.

Preferably, the container is collapsible into a flat pack for transportation by folding the end members down over the base member, and folding the side members down over the end members. The outer triangular sections of each webbing overlie an external side of a respective one of said end members when collapsed into the flat pack.

Preferably, the container is made of:

(a) a Polyethylene terephthalate (PET) film layer of 17 GSM;
(b) a low density poly ethylene (LDPE) layer;
(c) an inner kraft layer of 170 grams per square meter (GSM),
(d) a medium 190 GSM semi-chemical paper layer; and
(e) a laminate layer including:
  i. a kraft inside 150 GSM Kraft Liner;
  ii. a LOPE film 15 GSM; and
  iii. a kraft outside; MG50UnBL In accordance with one aspect of the invention there is also provided a flat pack including the above described container arranged in a collapsed condition of use.

In accordance with one aspect of the invention, there is also provided a blank for a container for reducing deterioration of horticultural produce, including:

(a) a parallelogram base member;

(b) first and second parallelogram side members, foldable to extend substantially normally from respective opposed sides of the base member;

(c) first and second parallelogram end members, foldable to extend substantially normally from respective opposed ends of the base member; and (d) four webbings coupled between neighbouring end sections of side members and end members, wherein each webbing of said webbings includes inner and outer triangular sections having a common apex at the base member and wherein the inner triangular section of each webbing is foldable to overlie an external side of a respective one of said end members.

Preferably, each inner triangular section extends between the base member and an upper section of a respective one of said end members.

Preferably, the inner triangular section of each webbing is foldable to overlie and is coupleable to an external side of a respective one of said end members.

Preferably, the outer triangular section extends between the base member and an upper section of a respective one of said side members.

Preferably, the blank is made of:

(a) a Polyethylene terephthalate (PET) film layer of 17 GSM;

(b) a low density poly ethylene (LDPE) layer;

(c) an inner kraft layer of 170 grams per square meter (GSM);

(d) a medium 190 GSM semi-chemical paper layer; and (e) a laminate layer including:

i. a kraft inside 150 GSM Kraft Liner;

ii. a LDPE film 15 GSM; and iii. a kraft outside; MG50UnBL

BRIEF DESCRIPTION OF THE DRAWINGS

Preferred embodiments of the present invention are hereafter described, by way of non-limiting example only, with reference to the accompanying drawing in which.

DETAILED DESCRIPTION OF PREFERRED EMBODIMENTS OF THE INVENTION

Figure 1:
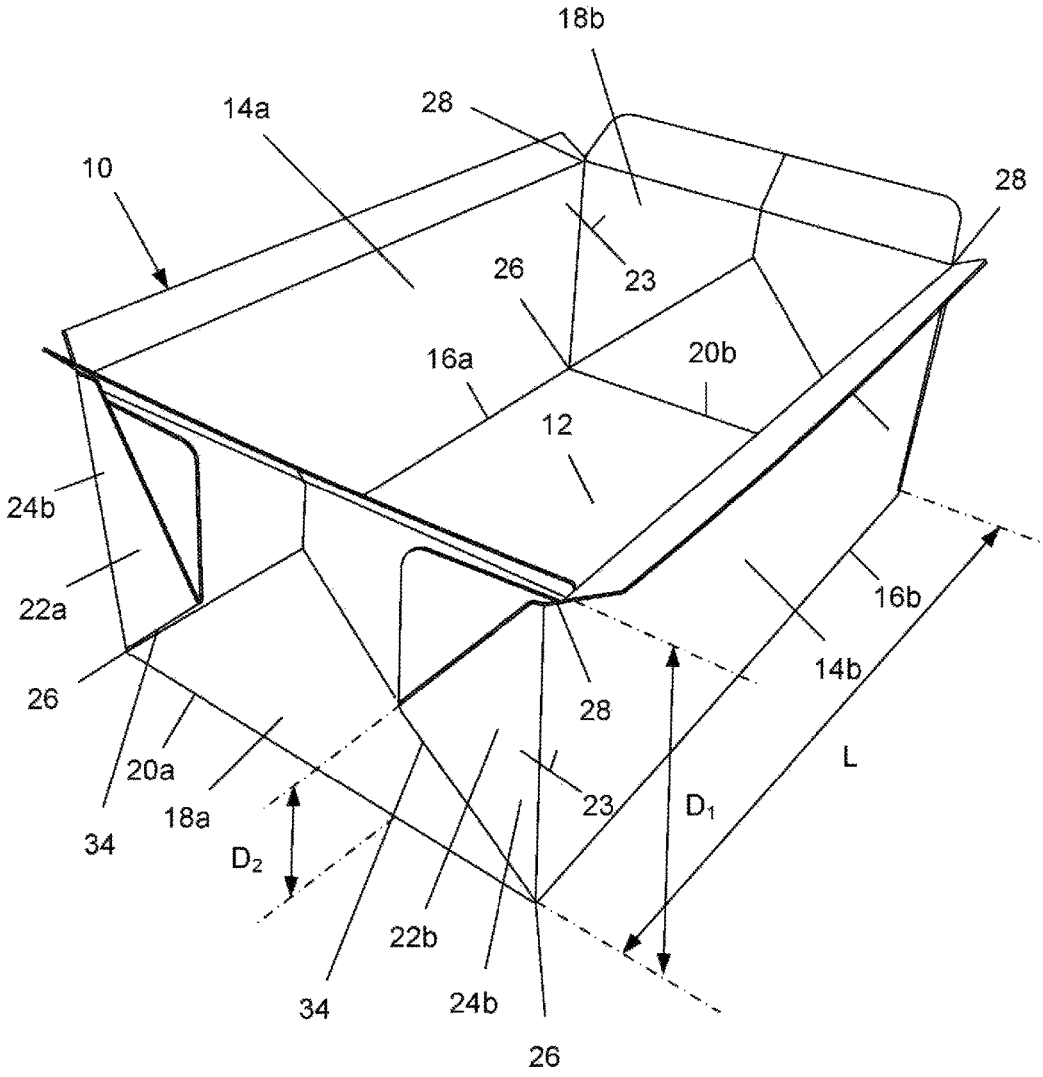
FIG. 1 is an end perspective view of a container.
Figure 2:
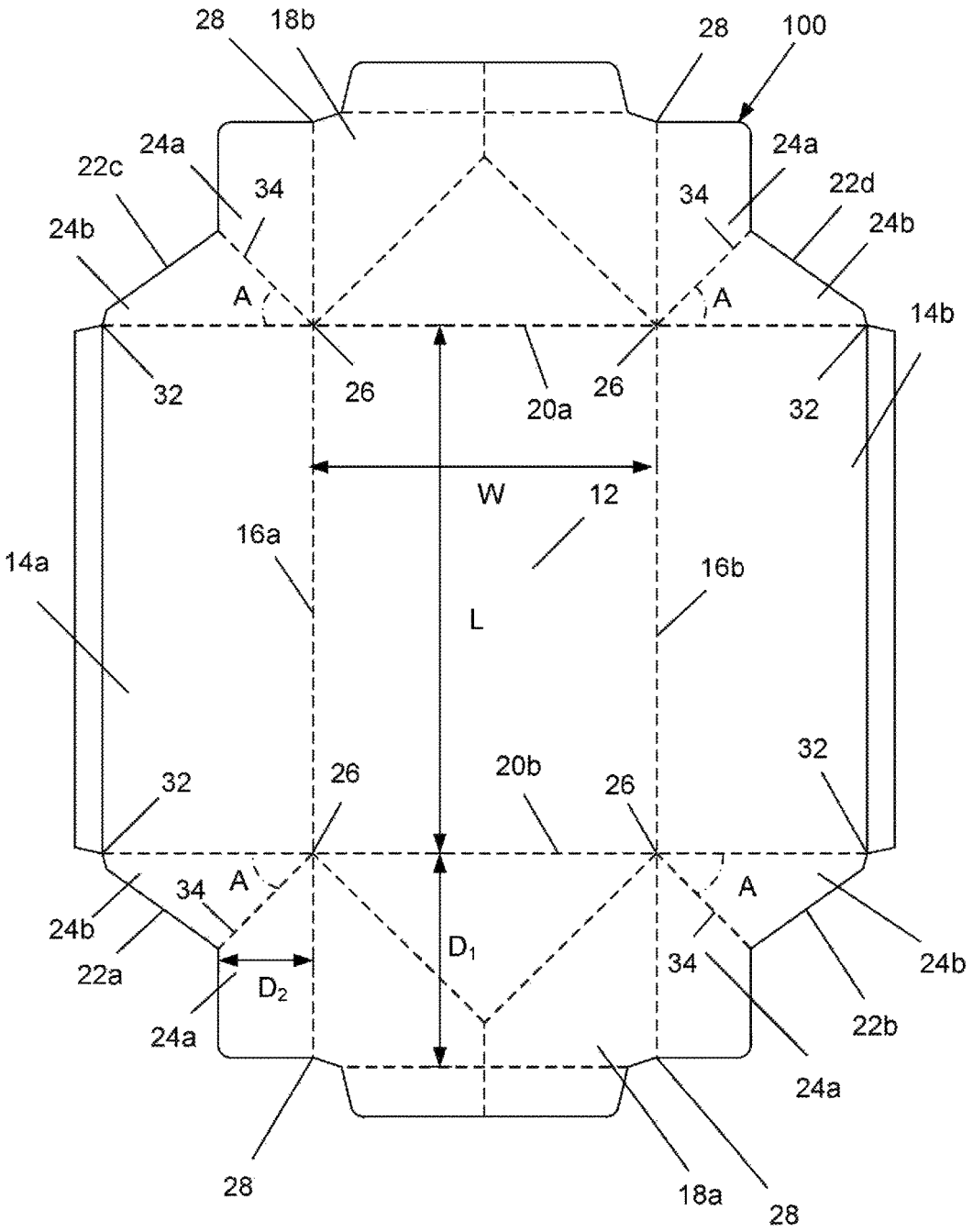
FIG. 2 is a plan view of a blank for the container shown in FIG. 1.
Figure 3:
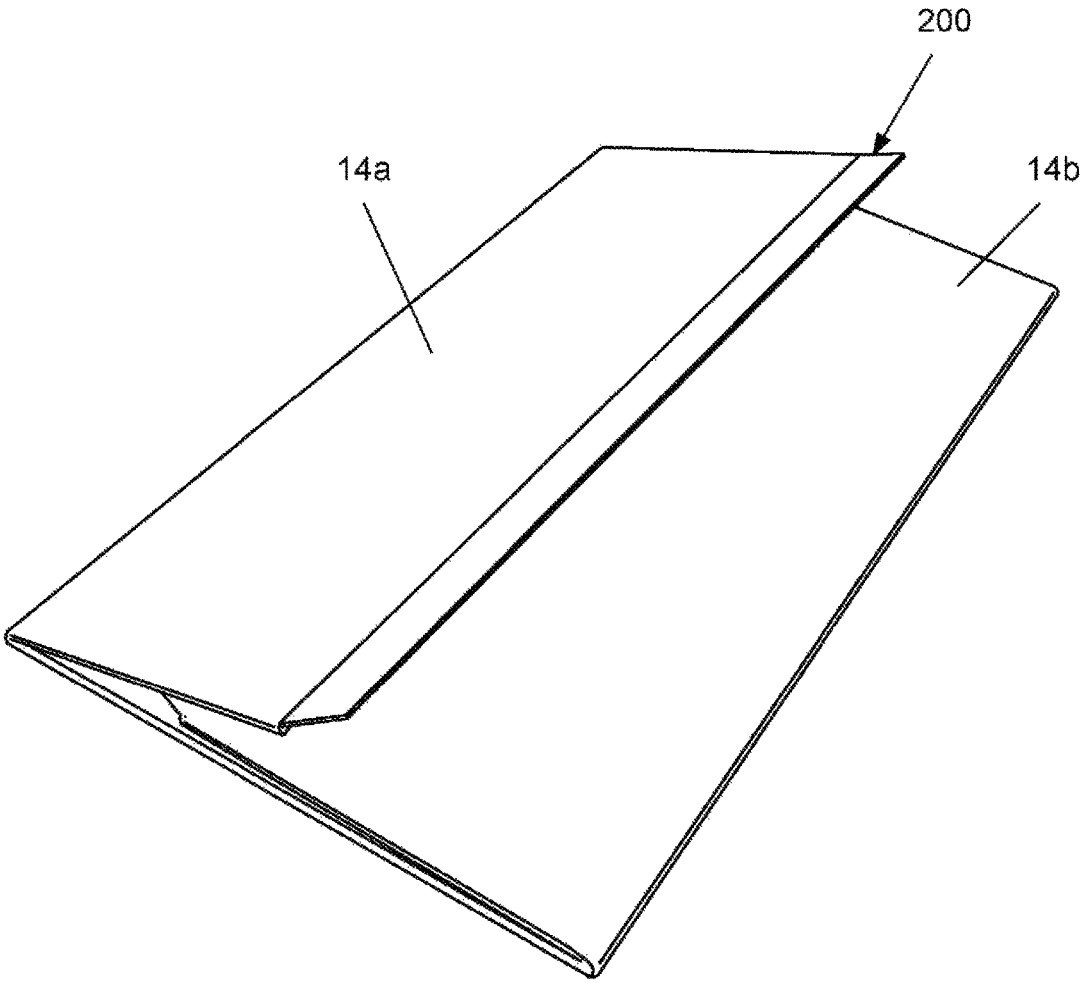
FIG. 3 is an end perspective view of the container shown in FIG. 1 arranged in a collapsed condition of use.
Figure 4:
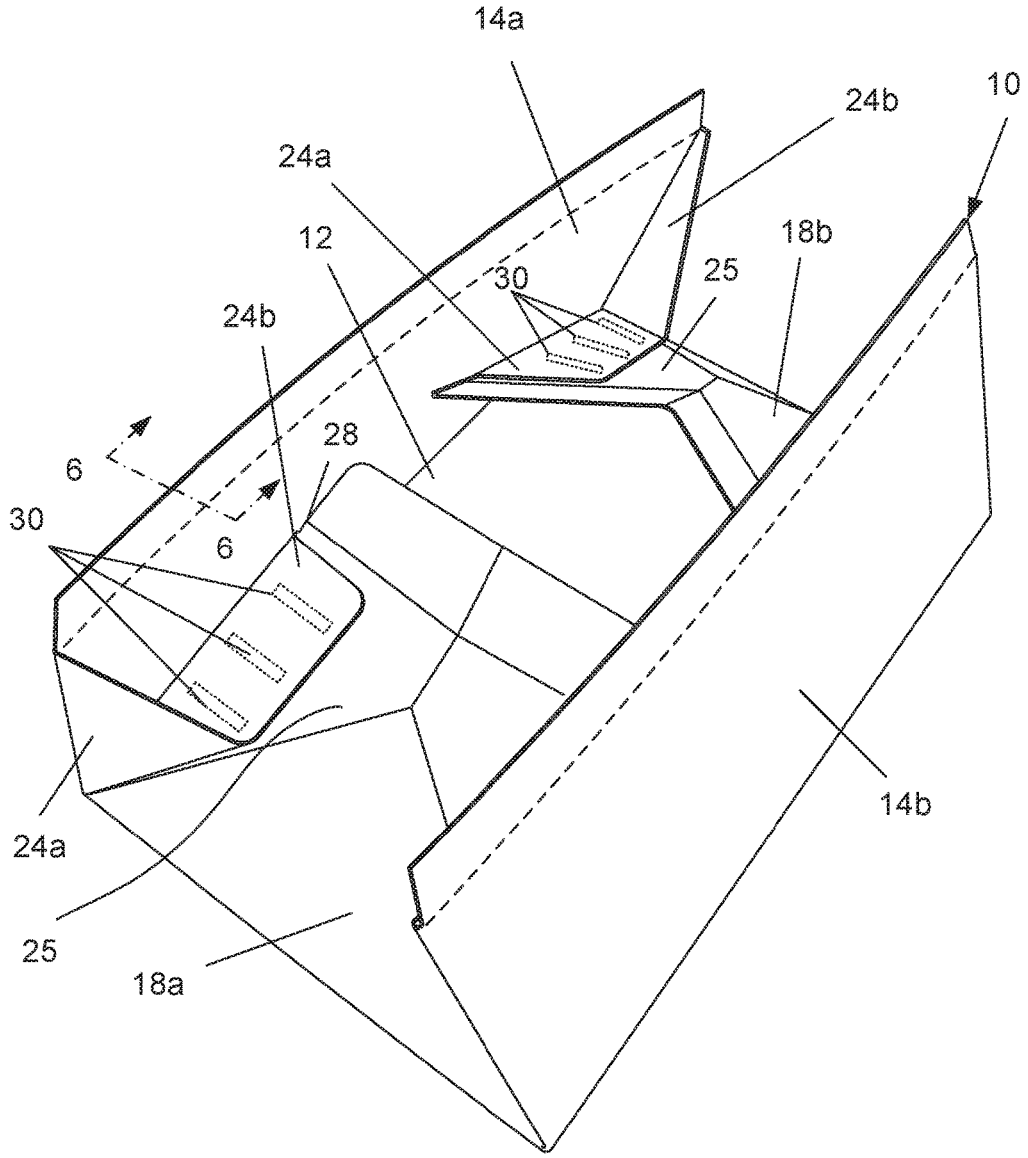
FIG. 4 is an end perspective view of the container shown in FIG. 3 arranged in another condition of use.
Figure 5:
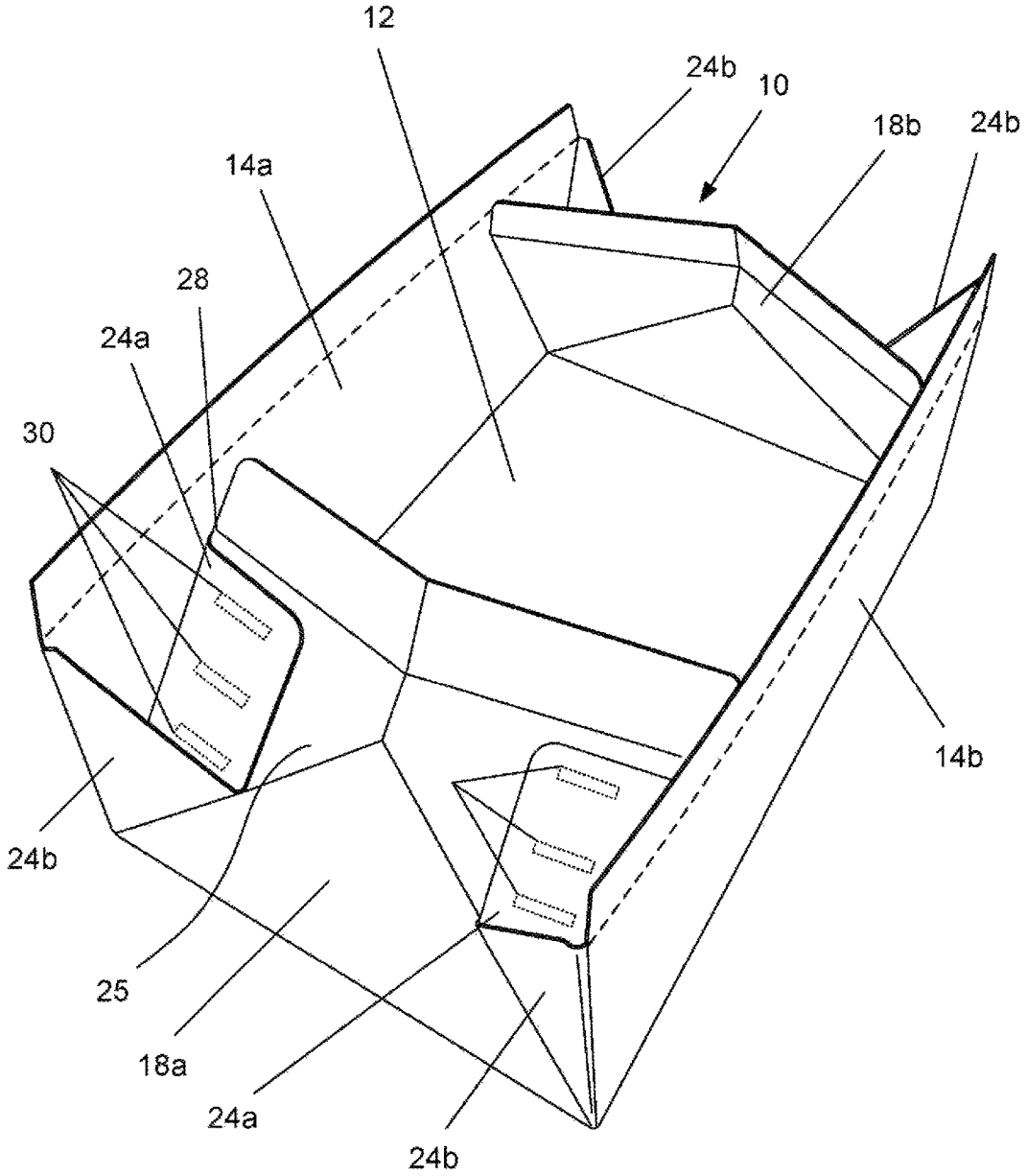
FIG. 5 is an end perspective view of the container shown in FIG. 3 arranged in yet another condition of use.

The container 10 shown in FIG. 1 is formed from the blank 100 shown in FIG. 2 in the manner set out in FIGS. 3 to 5. The container 10 is used to reduce deterioration of horticultural produce. The container 10 includes a parallelogram base member 12; first and second parallelogram side members 14*a*, 14*b*, each extending substantially normally from respective opposed sides 16*a*, 16*b* of the base member 12. The container 10 also includes first and second parallelogram end members 18*a*, 18*b*, each extending substantially normally from respective opposed ends 20*a*, 20*b* of the base member 12. Further, the container includes four webbings 22*a*, 22*b*, 22*c*, 22*d* coupled between neighbouring end sections 23 of side members 14*a*, 14*b* and end members 18*a*, 18*b*.

Each webbing 22*a*, 22*b*, 22*c*, 22*d* includes inner and outer triangular sections 24*a*, 24*b* having a common apex 26 at the base member 12. The inner triangular section 24*a* of each webbing 22*a*, 22*b*, 22*c*, 22*d* is foldable to overlie an external side 25 of a respective one of end members 18*a*, 18*b*.

As particularly shown in FIGS. 4 and 5, each inner triangular section 24*a* extends between the base member 12 and an upper section 28 of a respective one of the end members 18*a*, 18*b*. The inner triangular section 24*a* of each webbing 22*a*, 22*b*, 22*c*, 22*d* is preferably coupled to an external side 25 of a respective end member 18*a*, 18*b*. Each inner triangular end section 24*a* is coupled to a respective end member 18*a*, 18*b* by a fastener 30. Preferably, the fastener 30 is a glue. Alternatively, any other suitable fastener 30 can be used.

The outer triangular section 24*b* of each webbing 22*a*, 22*b*, 22*c*, 22*d* extends between the base member 12 and an upper section 32 of a respective side member 14*a*, 14*b*.

A common side 34 of the inner and outer triangular sections 24*a*. 24*b* of each webbing 22*a*, 22*b*, 22*c*, 22*d* extends at an angle of 45° upwardly from a plane of the base member 12. Alternatively, the common side 34 extends at a suitable alternative angle which is around 45°.

The container 10 has been designed with a view to holding 10 Kilograms of broccoli, for example. In this embodiment, the container 10 includes the following dimensions:

$D_1$=210 mm $D_2$=101 mm

L=542 mm

W=348 mm

A=45°

The container 10, blank 100 and 200 could include any other suitable combination of the above mentioned dimensions.

The upper end sections of the webbings 22*a*, 22*b*, 22*c*, 22*d* are raised a distance $D_2$ of from the plane of the base member 12. This distance reduces loss of fluids, such as ice water. from the container 12. Further, the webbings 22*a*, 22*b*, 22*c*, 22*d* are folded around respective end members 18*a*, 18*b* which has a sealing effect which inhibits egress of fluids such as ice water from the container.

Figure 6:
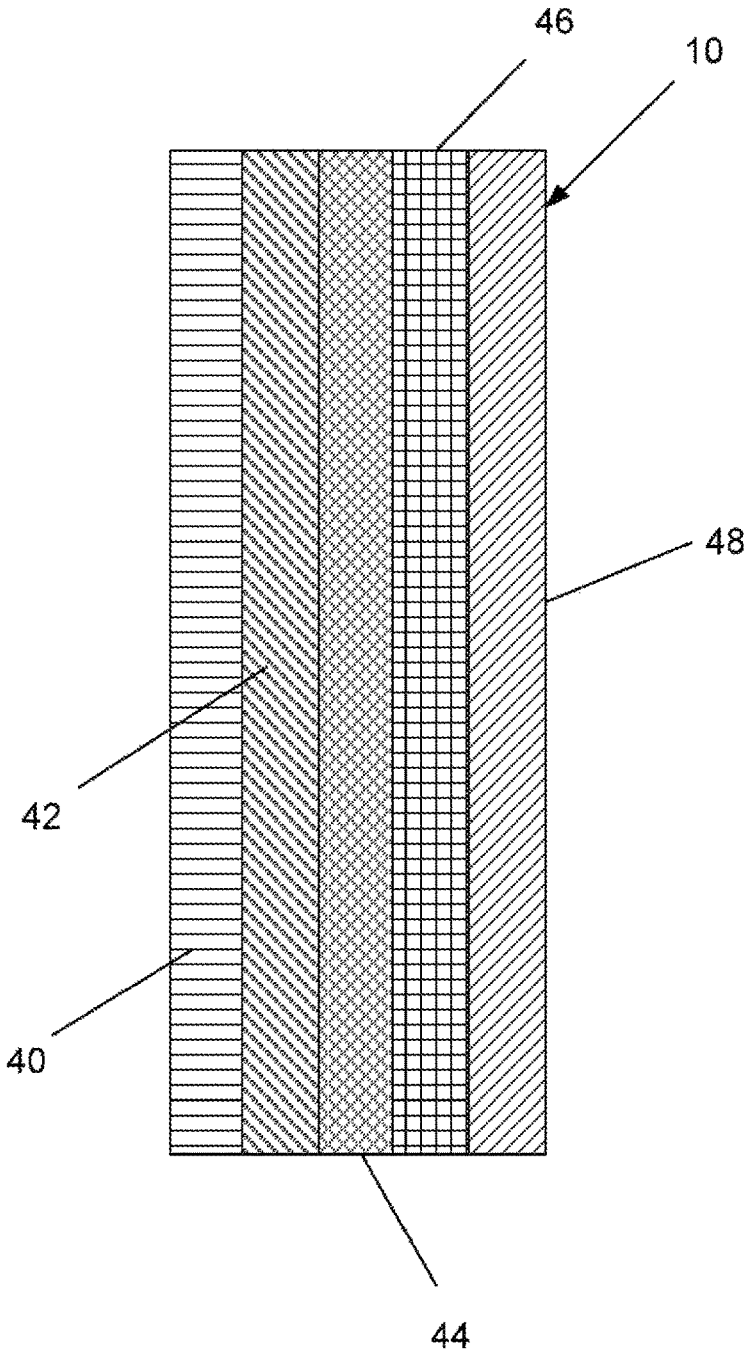
FIG. 6 is a section view through the line 6-6 of the container shown in FIG. 4.

As particularly shown in FIG. 6, the container 10 preferably includes the following layers of material:

a. a polyethylene terephthalate (PET) film layer 40 of 17 GSM;

b. a low density poly ethylene (LDPE) layer 42;

c. an inner kraft layer 44 of 170 grams per square meter (GSM);

d. a medium 190 GSM semi-chemical paper layer 46;

e. a laminate layer 48 including:

i. a kraft inside, 150 GSM Kraft Liner ii. a LDPE film 15 GSM;

iii. a Kraft outside; MG50UnBL

The PET film layer 42 provides at food grade water proof surface for ice and direct food contact.

The container 10 shown in FIG. 3 is collapsible into a flat pack 200 for transportation by folding the end members 18*a*, 18*b* down over the base member 12, and folding the side members 14*a*, 14*b* down over the end members 18*a*, 18*b* in the manner shown in FIG. 4. The outer triangular sections 24*b* of each webbing 22*a*, 22*b*, 22*c*, 22*d* overlie an external side 25 of a respective end member 18*a*, 18*b* when collapsed into the flat pack 200. The flat pack 200 is expanded into the container 10 in the manner shown in FIGS. 4 and 5 by reversing this process.

Advantageously, the outer triangular sections 24*b* of the webbings 22*a*, 22*b*, 22*c*, 22*d* are coupled to respective inner triangular sections 24*a*. The outer triangular sections 24*b* of the webbings 22*a*, 22*b*, 22*c*, 22*d* are preferably coupled to respective inner triangular sections 24*a* with a fastener such as an adhesive.

The container 10, blank 100 and 200 includes any other suitable combination of materials, as described in U.S. Pat. No. 5,609,293.

Outer or lid component being a full carton depth provides thermal insulation and a majority combined unit stacking strength. The layers of board also protect the inner vessel from impact and side intrusion from sharp objects.

Corrugated packaging is a more environmentally friendly alternative to polystyrene packaging. To this end, the corrugated packaging is a recyclable product.

The problems associated with warehousing the bulky poly styrene products are obviated by providing the erectable flat pack 200 to farmers. This also reduces cost of freight of erectable packaging to the farmers.

Many modifications will be apparent to those skilled in the art without departing from the scope of the present invention Throughout this specification, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference to any prior art in this specification is not, and should not be taken as, an acknowledgment or any form of suggestion that the prior art forms part of the common general knowledge in Australia.

The invention claimed is:

1. A container for reducing deterioration of horticultural produce, comprising:

(a) a parallelogram base member;

(b) first and second parallelogram side members, each extending substantially normally from respective opposed sides of the base member;

(c) first and second parallelogram end members, each extending substantially normally from respective opposed ends of the base member; and (d) four webbings coupled between neighbouring end sections of the first and second side members and the first and second end members, wherein each webbing of said webbings includes inner and outer triangular sections having a common apex at the base member and wherein the inner triangular section of each webbing is foldable to overlie an external side of a respective one of said end members; and the container further comprising:

(e) a polyethylene terephthalate (PET) film layer of 17 GSM;

(f) a low density poly ethylene (LDPE) layer;

(g) an inner kraft layer of 170 grams per square meter (GSM);

(h) a medium 190 GSM semi-chemical paper layer; and (i) a laminate layer including:

i. a kraft inside 150 GSM Kraft Liner;

ii. a LDPE film 15 GSM; and iii. a kraft outside; MG50UnBL.

2. The container claimed in claim 1, wherein each inner triangular section extends between the base member and an upper section of a respective one of said end members.

3. The container claimed in claim 1, wherein the inner triangular section of each webbing overlies and is coupled to an external side of a respective one of said end members.

4. The container claimed in claim 2, wherein each inner triangular end section is coupled to a respective one of said end members by a fastener.

5. The container claimed in claim 4, wherein the fastener is a glue.

6. The container claimed in claim 1, wherein the outer triangular section extends between the base member and an upper section of a respective one of said side members.

7. The container claimed in claim 1, wherein a common side of the inner and outer triangular sections of each webbing extends at an angle of around 45° upwardly from a plane of the base member.

8. The container claimed in claim 1, wherein the container is collapsible into a flat pack for transportation by folding the end members down over the base member, and folding the side members down over the end members.

9. The container claimed in claim 8, wherein the outer triangular sections of each webbing overlie an external side of a respective one of said end members when collapsed into the flat pack.

10. A flat pack including the container claimed in claim 8 arranged in a collapsed condition of use.

11. A blank for a container for reducing deterioration of horticultural produce, including:

(a) a parallelogram base member;

(b) first and second parallelogram side members, foldable to extend substantially normally from respective opposed sides of the base member;

(c) first and second parallelogram end members, foldable to extend substantially normally from respective opposed ends of the base member; and (d) four webbings coupled between neighbouring end sections of the first and second side members and the first and second end members, wherein each webbing of said webbings includes inner and outer triangular sections having a common apex at the base member and wherein the inner triangular section of each webbing is foldable to overlie an external side of a respective one of said end members; and the blank further comprising:

(e) a Polyethylene terephthalate (PET) film layer of 17 GSM;

(f) a low density poly ethylene (LDPE) layer;

(g) an inner kraft layer of 170 grams per square meter (GSM);

(h) a medium 190 GSM semi-chemical paper layer; and (i) a laminate layer including:

i. a kraft inside 150 GSM Kraft Liner;

ii. a LDPE film 15 GSM; and iii. a kraft outside; MG50UnBL.

12. The blank claimed in claim 11, wherein each inner triangular section extends between the base member and an upper section of a respective one of said end members.

13. The blank claimed in claim 11, wherein the inner triangular section of each webbing is foldable to overlie and is coupleable to an external side of a respective one of said end members.

14. The blank claimed in claim 11, wherein the outer triangular section extends between the base member and an upper section of a respective one of said side members.

15. The blank claimed in claim 11, wherein a common side of the inner and outer triangular sections of each webbing extends at an angle of around 45°.

* * * * *